US007814860B2

(12) United States Patent
Cerciello

(10) Patent No.: US 7,814,860 B2
(45) Date of Patent: Oct. 19, 2010

(54) ADHESIVE-SPREADING UNIT, IN PARTICULAR FOR BONDING MACHINES

(75) Inventor: Antonio Cerciello, Piacenza (IT)

(73) Assignee: Nordmeccanica S.p.A., Piacenza (IT)

( * ) Notice: Subject to any disclaimer, the term of this patent is extended or adjusted under 35 U.S.C. 154(b) by 1231 days.

(21) Appl. No.: 11/396,590

(22) Filed: Apr. 4, 2006

(65) Prior Publication Data

US 2006/0219165 A1 Oct. 5, 2006

(30) Foreign Application Priority Data

Apr. 4, 2005 (IT) ..... PC2005A0017

(51) Int. Cl.
*B05C 1/06* (2006.01)

(52) U.S. Cl. ..... 118/262; 118/261

(58) Field of Classification Search ..... 118/262, 118/686, 674, 672, 258, 244, 261, 263; 101/218, 101/247; 156/578
See application file for complete search history.

(56) References Cited

U.S. PATENT DOCUMENTS 3,303,814 A * 2/1967 Nitchie ..... 118/249
5,303,670 A * 4/1994 Rantanen ..... 118/228

* cited by examiner

*Primary Examiner*—Brenda A Lamb
(74) *Attorney, Agent, or Firm*—Young & Thompson

(57) ABSTRACT

An adhesive-spreading unit includes a set of rollers, each of which rotates at a higher speed than the preceding one, the first roller being in contact with a tank of adhesive and the last roller sliding in contact with a film on which the adhesive is to be deposited. The unit also includes devices for distancing the rollers from one another and bring them into contact when the film has been loaded into a machine, and a single actuator unit for moving the rollers. The actuator, during the first stage of its travel, brings a rubber-clad roller into contact with the first roller, and during the second part of its travel moves the two rollers to bring the rubber-covered roller into contact with a third roller, which transfers the adhesive to the film and vice versa.

7 Claims, 2 Drawing Sheets

ADHESIVE-SPREADING UNIT, IN PARTICULAR FOR BONDING MACHINES

SUMMARY OF THE INVENTION

This invention relates to an improved adhesive-spreading unit, designed in particular for machines designed for bonding films, such as two plastic films, a plastic film and a reel of paper, or the like.

The unit according to the invention, mounted on a carriage which enables it to be removed quickly and easily for cleaning operations or replacement, is characterised by the original configuration and layout of the parts, especially the adhesive transfer rollers, which produces a simpler, more compact unit composed of fewer parts than known units.

In particular, the unit according to the invention features a single drive system which brings the rollers that take up the adhesive and transfer it to the film into contact with one another.

In the machine according to the invention, said rollers are installed at an angle of approximately 90°, and the intermediate rubber-clad roller which transfers the adhesive from a take-up roller to an applicator roller is subject to the action of a single actuator, which brings it into contact with the take-up roller in the first part of its travel and also with the spreader roller in the second part of its travel.

The result is a more compact unit which eliminates the need for two motors, as is the case with known units, because all the movements of the various parts are driven by a common actuator.

The machines used to bond plastic films, or a plastic film and a reel of paper, include adhesive-spreading devices consisting of a roller which takes up a thin layer of adhesive from a tank and transfers it to a second, usually rubber-clad roller, which moves at a higher speed, so as to reduce the thickness of the layer of adhesive collected, which is transferred to a third roller that rotates at an even higher speed, and slides in contact with the film, depositing the adhesive on it.

In currently known machines these rollers are substantially aligned or staggered by a few centimeters.

When the machine is started up, the rollers must be distanced from one another: the first roller is brought up to full speed, so that it takes up a thin, even layer of adhesive; the second, rubber-clad roller is then brought into contact with the first roller, and when the second roller has also reached full speed and the adhesive is being transferred evenly, the first two rollers are brought into contact with the applicator roller, thus triggering the advance of the film.

This solution, which is schematically illustrated in FIG. 1, involves the use of two separate actuators, shown as 1 and 2, the first being used to move rubber-clad roller 3 and the second to move an assembly consisting of a support 4 with rubber-clad roller 3 and adhesive take-up roller 5, so that they rest against applicator roller 6.

Actuators 1 and 2 are generally constituted by hydraulic or pneumatic cylinders, but can also be made with any other known system.

As mentioned, this solution means that the unit is rather large, because the rollers are substantially aligned, and because of the need for two separate movement systems to move the rollers located upstream of applicator roller 6.

The present invention, which falls into this sector, relates to an improved adhesive-spreading unit for bonding machines, wherein the rollers are installed substantially at a 90° angle, thus reducing the length of the system, and wherein a single actuator is installed, which brings the rubber-clad roller into contact with the take-up roller during the first part of its travel and brings said two rollers into contact with the applicator roller in the second part of its travel.

BRIEF DESCRIPTION OF THE DRAWINGS

This invention will now be described in detail, by way of example but not of limitation, by reference to the annexed figures wherein.

DETAILED DESCRIPTION OF THE PREFERRED EMBODIMENTS

Figure 2:
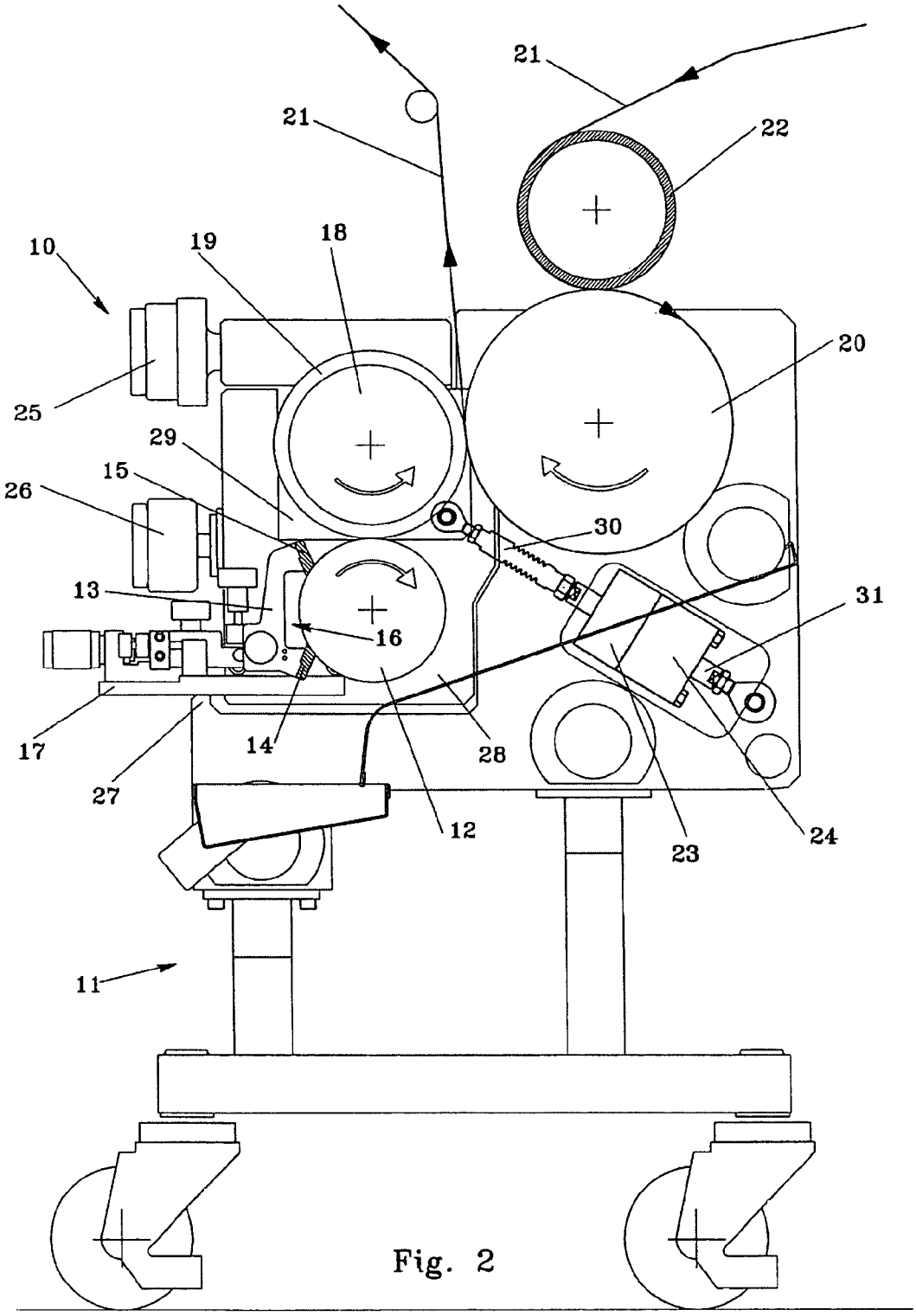
FIG. 2 is a schematic cross-section of a spreading unit according to the invention.

In FIG. 2, no. 10 indicates the spreading unit according to the invention, mounted on a carriage 11 which allows it to be inserted easily in the bonding machine and removed for cleaning, maintenance and replacement operations.

The spreading unit comprises a first metering or take-up roller 12, made of steel with an engraved surface, which slides in contact with a device 13 fitted with a double doctor blade or a closed doctor blade, which presents a lower doctor blade 14 and an upper doctor blade 15 in contact with the surface of cylinder 12, which said blades define a cavity 16 that constitutes a kind of tank into which the adhesive to be spread on the film is fed by devices of known type.

Doctor blade assembly 13 is preferably mounted on a slide 17 which enables it to be distanced from roller 12.

A roller 18 with rubber cladding 19 which rotates at a higher speed than the preceding one takes up the layer of adhesive collected by roller 12 and transfers it to a third steel roller 20, which rotates at a higher speed than the preceding ones.

Film 21 is passed over roller 20, in contact with said roller, and pressed by a counter-roller 22.

The adhesive is collected by roller 12, passes over roller 18, where its thickness is reduced due to the higher speed of roller 18, and from roller 18 is conveyed to roller 20, with a further reduction in thickness, to be transferred to the film.

A characteristic feature of the invention is the single actuator unit constituted by a pair of pneumatic pistons 23 and 24, arranged in series, possibly but not necessarily inside the same cylinder.

Roller 18 is mounted on a pair of abutments 29; said abutments are mounted on a structure 28, which in turn is mounted on the abutments of the machine.

Abutments 29 can slide vertically in relation to structure 28 to raise roller 18, distancing it from roller 12, and structure 28 can slide in a substantially horizontal direction on the abutments of the machine, to distance rollers 12 and 18 from roller 20.

These movements are controlled by the actuator unit consisting of pneumatic pistons 23 and 24, which said unit is hinged to the structure of the machine in such a way that it can oscillate slightly.

Pistons 23 and 24 drive one rod each, shown as 30 and 31 respectively, which are inclined in relation to the direction of movement of rollers 12 and 18, for example at an angle of approximately 45°.

The force exerted by rods 30 and 31 is broken down into two directions, vertical and horizontal respectively.

Structure 28 is mounted on the abutments of the machine with the insertion of skids or other systems which allow the structure to slide with no need to apply great force; in particular, the force required to slide structure 28 must be less than the force required to raise abutments 29 with roller 18.

The two pneumatic pistons 23 and 24 are supplied with air at different pressures.

Figure 3:
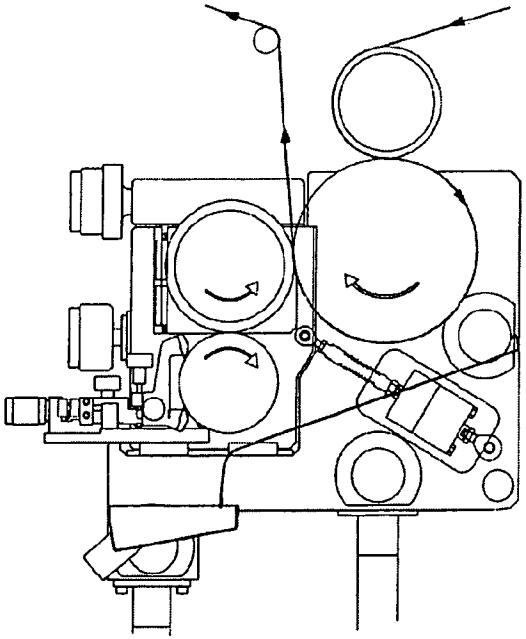
FIGS. 3 to 5 schematically illustrate a spreading unit according to the invention with the rollers in different positions.

By supplying air at lower pressure to piston 23, the horizontal component of the force exerted by the rod is sufficient to control the movement of structure 28, which slides to the left (FIG. 3) until it abuts against abutment 27 (FIG. 2) of the structure of the machine, thus distancing rollers 12 and 18 from roller 20. The machine is then in the position illustrated in FIG. 3, which shows the space formed between structure 28 and the abutments of the machine.

If air is then conveyed at a higher pressure to piston 24, sufficient strength is imparted to the piston rod to overcome the weight of roller 18 and raise abutments 29 on which said roller is mounted.

Structure 28 does not move, however, because its movement is prevented by the fact that it engages with abutment 27.

Figure 4:
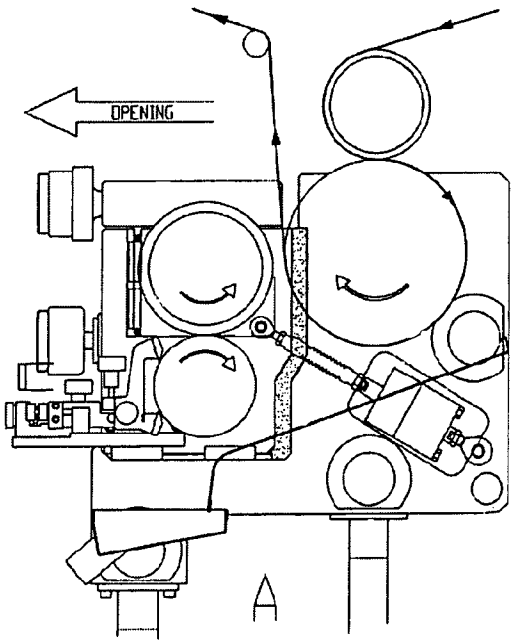
Figure 5:
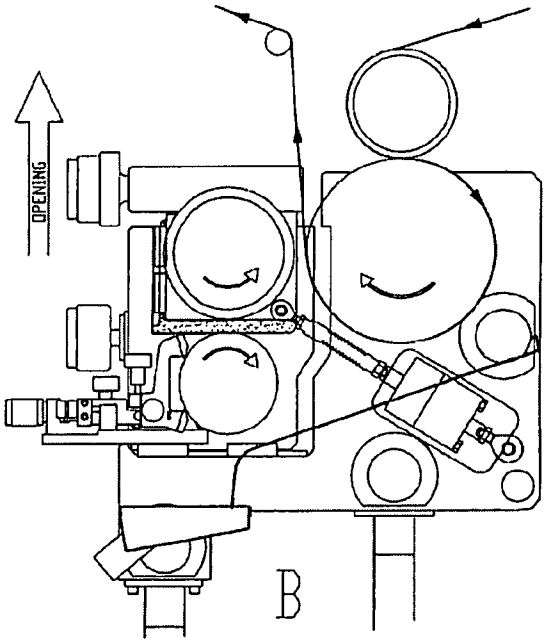
Figure 1:
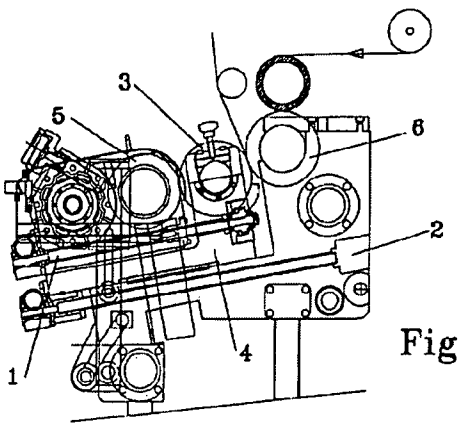
FIG. 1 schematically illustrates the layout of the rollers in a spreader according to the prior art.

The machine is then in the position illustrated in FIG. 4, with all three rollers 12, 18 and 20 separated from one another.

In accordance with a further preferred embodiment of the machine according to the invention, a single piston could be used instead of pistons 23 and 24, and successively supplied with air at different pressures: a first, lower pressure to control the movements of structure 28 on the horizontal plane, and a second, higher pressure to control the subsequent lifting of abutments 29 with roller 18.

A pair of registers 25 and 26 are also fitted, allowing the distance, and consequently the pressure between the pairs of rollers 16-18 and 18-20 to be regulated micrometrically when said rollers are in contact with one another in the operating position, to vary the amount of adhesive taken up and transferred to the film.

The device operates as follows.

When work begins or resumes, rollers 12, 18 and 20 are distanced by means of actuator unit 23 and 24, the film is loaded by coupling one end thereof to the rereeling devices, and the adhesive is conveyed to tank 16 formed between doctor blades 14 and 15, in contact with roller 12, and heated to the required temperature. Roller 12 is then started up, and collects a certain quantity of adhesive which is then scraped by doctor blade 15, leaving on the roller only the adhesive contained in the grooves engraved on its surface.

After a few revolutions, having checked that the adhesive is correctly taken up, actuator 24 is activated to control the retraction of rod 31 and bring roller 18 close to roller 12, thus transferring the adhesive collected by the take-up roller to rubber-clad surface 19 of roller 18.

Once again, a few revolutions are enough to bring the machine to full operation and check that the adhesive passes regularly from roller 12 to roller 18 and is spread in a layer of uniform thickness, after which actuator 23 is activated to recall rod 30 and drive the set of rollers 12 and 18 against roller 20 during this second part, so that the adhesive on the rubber-clad roller is transferred to roller 20.

The machine is now in full operation and work can proceed until a change to a new reel is required, at which point the machine must be shut down and the procedure described above repeated.

As will be clear from the description supplied, the spreading unit according to the invention offers considerable advantages, because it is shorter and more compact than known devices and simpler to manufacture, a single actuator unit being sufficient to control all the movements of the various parts, unlike the spreaders according to the prior art, in which two separate actuators are required, with the corresponding slides and control devices.

An expert in the field could devise various modifications and variations, all of which should be deemed to fall within the ambit of this invention.

The invention claimed is:

1. An adhesive-spreading unit, comprising:

a plurality of rollers (12, 18, 20), a first roller (12) being in contact with a tank (16) of adhesive, a second rubber-clad roller (18) having a perimeter of rubber claddings (19) and configured to rotate faster than the first roller (12), and a third roller (20) in sliding contact with a film (21) on which an adhesive is to be deposited and configured to rotate faster than the rubber-clad roller (18);

a tank (16) configured to contain adhesive;

a single actuator unit (23, 24, 30, 31);

a mobile structure (28) mounted to machine abutments of the adhesive-spreading unit;

a pair of abutments (29) mounted on the mobile structure (28), the rubber-clad roller (18) mounted on the pair of abutments (29), the pair of abutments (29) configured to move in a first direction in relation to the mobile structure (28), and the mobile structure (28) being configured to move along a second direction in relation to the machine abutments, the single actuator unit (23, 24, 30, 31) configured to control movements of the mobile structure (28) and the pair of abutments (29) in order to distance the rollers from one another in a first mode and bring the rollers into contact in a second mode; and stop means (27) fitted to the single actuator unit (23, 24, 30, 31) configured to limit a slide of the mobile structure (28) along the second direction, wherein the single actuator unit (23, 24, 30, 31) is configured to act on the pair of abutments (29) in an inclined direction in relation to the first and second directions so that, during a first stage of travel of the of the single actuator unit (23, 24, 30, 31), the rubber-clad roller (18) is brought into contact with the first roller (12) for taking up the adhesive from the tank (16), and during a second part of the travel of the single actuator unit (23, 24, 30, 31), the first roller and the rubber-clad roller (12, 18) move until the rubber-clad roller (18) contacts the third roller (20) to transfer the adhesive to and from the film (21).

2. The adhesive-spreading unit as claimed in claim 1, wherein the single actuator (23, 24, 30, 31) is configured to act on the pair of abutments (29) according to a direction having an inclination such that a first component required to move the mobile structure (28) along the machine abutments is less than a second component required to move the pair of abutments (29) with the rubber-clad roller (18).

3. The adhesive-spreading unit as claimed in claim 2, wherein longitudinal axes of the first, rubber-clad, and third rollers (12, 18, 20) are arranged parallel to one another and virtual lines connecting the axes of the rollers form a substantially right angle.

4. The adhesive-spreading unit as claimed in claim 1, wherein longitudinal axes of the first, rubber-clad, and third rollers (12, 18, 20) are arranged parallel to one another and virtual lines connecting the axes of the rollers form a substantially right angle.

5. The adhesive-spreading unit as claimed in claim 4, further comprising:

registers (25, 26) configured to micrometrically regulate a first distance between the first roller (12) and the rubber-clad roller (18) and a second distance between the rubber-clad roller (18) and the third roller (20) when said rollers are in contact in an operating position, in order to respectively regulate a first pressure between the first roller (12) and the rubber-clad roller (18) and a second pressure between the rubber-clad roller (18) and the third roller (20).

6. The adhesive-spreading unit as claimed in claim 5, wherein the third roller (12) rotates in contact with the tank (16), and wherein the tank (16) is demarcated at lower and upper edges by a pair of doctor blades (14) in contact with a surface of the third roller (12).

7. The adhesive-spreading unit as claimed in claim 6, wherein the doctor blades (14) are mounted on a support (17) moveable along a skid integral with the mobile structure (28).

* * * * *